United States Patent [19]

Hamilton

[11] 4,183,108

[45] Jan. 15, 1980

[54] FLUSH TOILET SYSTEM

[76] Inventor: William H. Hamilton, 16765 32nd Ave., SW., Seattle, Wash. 98166

[21] Appl. No.: 952,130

[22] Filed: Oct. 17, 1978

Related U.S. Application Data

[63] Continuation-in-part of Ser. No. 812,066, Jul. 1, 1977, Pat. No. 4,142,262.

[51] Int. Cl.[2] ..... E03D 3/10; E03D 1/22

[52] U.S. Cl. ..... 4/354; 4/362; 4/363; 4/370; 4/415

[58] Field of Search ..... 4/362, 363, 370, 354, 4/415, 361, 343, 438, 366, 367, 326, 345; 137/572, 628

[56] References Cited

U.S. PATENT DOCUMENTS

| | | | |
|---|---|---|---|
| 2,190,773 | 2/1940 | Dunn | 4/363 |
| 3,344,439 | 10/1967 | Davies | 4/326 |
| 3,431,564 | 3/1969 | Davies | 4/325 |
| 3,605,125 | 9/1971 | Gibbs et al. | 4/361 |
| 3,820,171 | 6/1974 | Larson | 4/360 |
| 4,044,407 | 8/1977 | Silcox | 4/325 |

*Primary Examiner*—Henry K. Artis

*Attorney, Agent, or Firm*—Strauch, Nolan, Neale, Nies & Kurz

[57] ABSTRACT

A water reservoir tank storing a primary body of water for release to a toilet bowl for flushing is associated with a pressure tank that stores a minor amount of water at a pressure considerably higher than that of the primary body and is discharged during flushing to join the water released from the reservoir tank and impart increased overall energy to the water in the bowl. A predetermined time delay is introduced between start of the flushing action and discharge of water from the pressure tank. The pressure tank is automatically discharged and recharged during each flushing cycle.

8 Claims, 2 Drawing Figures

FLUSH TOILET SYSTEM

This is a continuation-in-part of Ser. No. 812,066 filed July 1, 1977, now U.S. Pat. No. 4,142,262.

This invention relates to a novel system for flush toilets of the type wherein a body of water stored in a reservoir tank is selectively released into a toilet bowl, and particularly to improvements therein enabling efficient flushing while using less water.

To obtain the flushing action of most conventional flush toilets, such as the usual household toilets, water under pressure is released into the toilet bowl creating the swirling velocity necessary to start the siphoning action and flush the standing water in the toilet bowl and its contents from the bowl to the drain. This pressure is conventionally obtained from the potential energy of a body of stored water which generally consists of five or more gallons of water stored at an elevation of approximately one foot above the toilet bowl. This system is wasteful and inefficient in that a relatively large quantity of water is required since the limited elevation of the stored water imparts only a relatively small amount of energy to the flushing water.

It has also been proposed to replace conventional household tanks with so-called hydraulic systems having sealed tanks wherein a body of water is stored at substantially intake mains pressure and released. In such systems air is compressed within a storage tank by inlet water from the supply mains which may have pressures up to one hundred pounds per square inch, and when the tank discharge is effected the expanding air rapidly expels the water from the tank into the toilet bowl. A savings in water usage has been alleged for this type of system. Reference is made to U.S. Pat. Nos. 2,658,203; 3,397,408; 3,677,294; 3,817,279; 3,817,286 and 3,820,171 which disclose such hydraulic systems.

As will be observed one of the practical difficulties attendant these hydraulic systems is that for existing installations the usual household storage tank, which is normally regarded as a lifetime component, must be discarded and replaced by a special sealed tank having the required volume. This makes conversion expensive, and the large sized sealed tanks required for both conversion and original installations are expensive.

In the system of the present invention, a stored body of water is released toward the toilet bowl as in the aforesaid conventional household systems and at the same time additional energy is imparted thereto in a controlled manner to increase the efficiency of flushing while utilizing less water overall than in the conventional system, and this is a major object of invention.

Thus in the system of the invention the major components of the conventional system may be retained and there is a minimum of modification thereby reducing expense. By the same token the invention may be incorporated into new installations using conventional type components, thereby advantageously using existing inventories.

Another object of the invention is to provide a novel flush toilet system wherein during flushing a primary body of stored water is discharged for gravity flow to the toilet bowl and after a predetermined time delay and during such discharge is further energized by the introduction thereinto of a relatively small amount of water at higher velocity.

It is a further object of the invention to provide a novel flush toilet system comprising a primary water storage tank having a water level control such as a float controlled water inlet valve and a discharge valve, and a pressure tank that is automatically recharged with water at substantially inlet mains pressure during each flushing cycle, together with an arrangement whereby water controlled by novel time delay means is automatically discharged at high velocity from the pressure tank into the water descending from the primary water body after the tank discharge valve opened.

It is a further object of the invention to provide a novel flush toilet system having a primary water storage tank having a discharge valve at its outlet, a pressure tank for containing water under pressure, a conduit connecting the outlet of said pressure tank to the outlet of said primary tank, and means including control valve means responsive to a flush operation initiated by opening said discharge valve and provided with novel time delay means for sequentially expelling water from said pressure tank through said conduit and then recharging the pressure tank.

Another object of the invention is to provide a flush toilet system wherein a pressure tank charged with water and a body of compressed air has an outlet control valve through which the water is discharged to join water from a reservoir water supply in flushing a toilet bowl, characterized by the control valve being actuated upon initiation of discharge from said water supply for a flushing action and the provision of means for interposing a predetermined time delay between start of the flushing action and opening of said control valve. Pursuant to this object the control valve is operated in response to a lowered pressure condition produced by initiation of a flushing action and there is provided a check valve tube that is filled with a predetermined amount of water during charging of the pressure tank and to said lowered pressure condition and arranged to empty in response before said control valve is opened.

A further object of the invention is to provide in a flush toilet system wherein a control valve for the outlet of a pressure tank containing water stored under high pressure from a body of compressed air within the tank is actuated a predetermined time after initiation of a flushing operation.

Further objects of the invention will appear as the description proceeds in connection with the appended claims and the annexed drawings.

PREFERRED EMBODIMENTS

Figure 1:
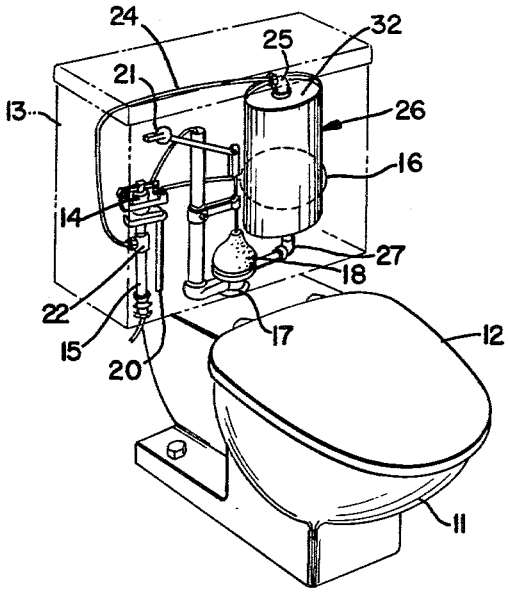
FIG. 1 is a generally perspective view showing a toilet system wherein the invention is incorporated.

FIG. 1 shows a flush toilet assembly having a bowl 11 that may be closed by seat cover 12, and a flush water reservoir tank 13 in the form of a rectangular porcelain or metal tank. A float operated intake valve 14 is mounted at the upper end of a water intake pipe 15. Valve 14 has an outlet 20 into tank 13 and is connected by a rod to float 16. The water pressure in pipe 15 is normally that of the supply mains, between 30 and 100 pounds per square inch and normally about 60 pounds per square inch. Float 16 acts to close intake valve 14 when there is a certain water level in tank 13. At the bottom of tank 13 is a tank outlet fixture 17 through which water from the tank is discharged into the bowl when valve 14 is opened and the toilet is flushed. From the lower end of fixture 17 there may be any conventional distribution of the water around and into the bowl.

A ball valve element 18 is adapted to seat upon by gravity and normally close the upper end of tank outlet fixture 17, thereby serving as a tank discharge valve, and ball 18 may be attached to a cable or rod 19 leading to an external handle such as 21, whereby when it is desired to flush the toilet the operator merely pulls ball 18 up off its seat to start discharge of the contents of the tank. As the water level in tank 13 recedes, the float opens valve 14 and the tank starts to fill but of course at a much slower rate than the discharge at 17. The released valve element 18 descends by gravity eventually reseating on fixture 17 to stop discharge into the bowl altogether and allow the water in the tank to regain its certain level at which time intake valve 14 closes.

The foregoing structure and operation may be conventional and in fact as will appear the parts introduced according to the invention may readily convert a conventional flush toilet structure to the invention.

Figure 2:
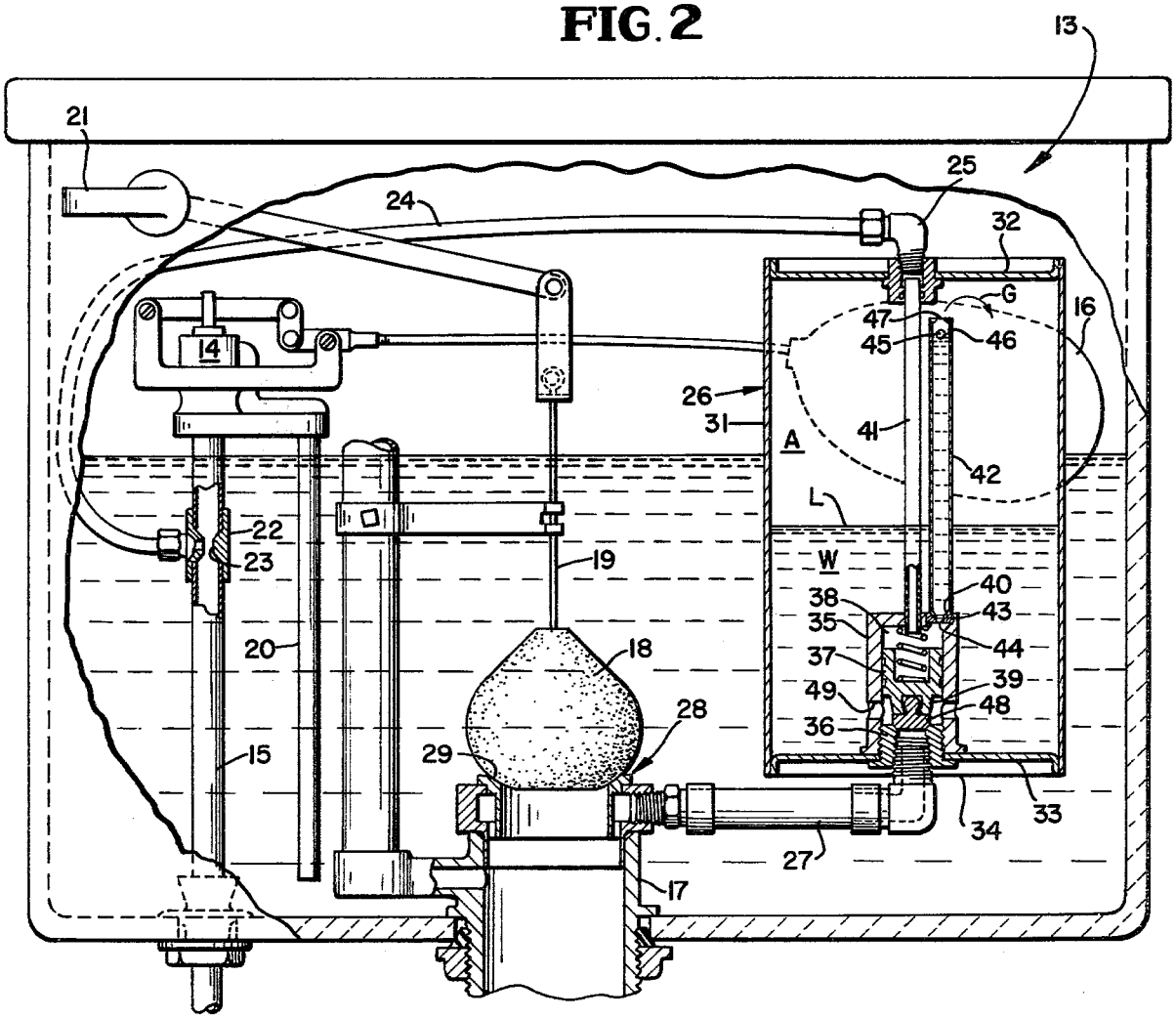
FIG. 2 is an enlarged view partly broken away and in section showing detail of the invention in a preferred embodiment.

As illustrated in FIG. 2 the water intake pipe 15 is modified below the float valve 14 to incorporate a venturi section 22 wherein the internal pipe diameter is reduced at 23 for increased flow velocity and localized lower fluid pressure for a purpose to appear. An inlet tube 24 extends from venturi section 22 to a fitting 25 in the upper end of a sealed pressure tank 26. An outlet conduit 27 extends from the bottom of pressure tank 26 to an annular nozzle assembly 28 on outlet fixture 27, an inclined annular seat 29 being provided on the nozzle assembly for normally sealing reservoir tank discharge valve element 18. Conduit 17 is relatively rigid and may provide the main support for pressure tank 26, so that for a known dimension toilet unit the inlet tube 24, pressure tank 26, outlet conduit 27 and nozzle assembly 28 may be preassembled prior to introduction as a unit into the reservoir tank 13. The nozzle assembly 28 may assume any of the forms disclosed in said Ser. No. 812,066.

Pressure tank 26 has a cylindrical side wall 31 sealed pressure tight to a top wall 32 where fitting 25 enters and a bottom wall 33 wherein outlet conduit 27 is attached to a fitting 34. A control valve comprises a valve actuator cylinder 35 secured to the inner end of fitting 34 which extends up into the tank and provides an annular frusto-conical valve seat 36. A piston 37 is vertically slidable in cylinder 35 in which it defines an upper water intake space 38 and a lower water discharge space 39.

Tube 41 which is an effective continuation of inlet tube 24 extends from fitting 25 down to space 38, and a receptacle in the form of a check valved time delay tube 42 extends from the upper wall of cylinder 35 to provide an outlet from space 38. As shown the upper discharge end of tube 42 is advantageously above the waterline L within the cylinder and above the normal preflush waterline level in the reservoir tank.

The lower end of tube 42 is fixed upon an orifice member 43 seated in the upper wall of cylinder 35. Orifice member 43 provides a predetermined size passage 44 between space 38 and the interior of tube 42 for a purpose to appear. Similarly tube 42 is of uniform diameter and predetermined size and water capacity contributing to that purpose.

A check valve member comprising a ball 45 of larger diameter than passage 44 mounted on a suitable carrier 46 has a specific gravity less than one enabling it to float freely on the top of the water column within pipe 42. The upper end of passage 44 is preferably conical to provide a check valve seat 40 for ball 45 when the ball is in the lower end of tube 42, for a purpose to appear. Carrier 46 is preferably of spider-like configuration with radical spokes for minimum resistance to water flow past the ball 45. The upper end of tube 42 is turned in or otherwise formed to provide an outlet opening 47 of smaller diameter than ball 45, so that as the water column rises in tube 42 the floating ball 45 will not escape through opening 47.

A control valve element 48 is mounted on the lower end of piston 37 and is formed to seat onto conical seat 36. Preferably element 48 has a relatively loose ball and socket connection with piston 37 so that it is self centering for full closure engagement on seat 36 when the piston descends. A light compression spring 40 may be provided in space 38 and may be omitted in some installations, as a pressure differential across the valve piston may provide the necessary operation as will appear.

A plurality of openings 49 in the cylinder wall provide constant communication of space 39 with the lower interior of pressure tank 26.

In operation, assume a starting condition wherein valve ball 18 is seated at 29 to close the reservoir tank discharge valve and water at mains pressure enters through pipe 15 and valve 14 until the reservoir fills to a certain level so that float 16 causes valve 14 to close. At this point there is no water in the pressure tank 26 and check valve ball 45 is seated at 40.

After closure of intake valve 14, inlet water that is blocked by valve 14 flows now at mains pressure through tube 24 into pressure tank 26. Thus water from tube 41 at inlet mains pressure enters control valve cylinder space 38 from which it exits through orifice 44 into tube 42 into pressure tank 26 as indicated by arrow G. As tube 42 fills with water ball 45 leaves seat 40 and rises with the water level in the tube. When tube 42 is filled with water ball 45 is retained therein at outlet 47 through which water flows into the pressure tank.

Piston 37, which is already urged toward its lower control valve closing position by gravity, and by spring 40 if present, is even further biased in that direction by the inlet water pressure in space 38 to close the control valve. Water continues to accumulate within pressure tank 26 toward a level therein indicated at L, while gradually compressing the air trapped in the upper part of the cylinder. The water body in pressure tank 26 is indicated at W, and the compressed air body at A. When the water level reaches L, air in body A has been compressed to the extent that its pressure is equal to the water intake pressure of water body W, and flow of water from tube 42 into the pressure tank 26 ceases. The amount of water in body W now in the pressure tank is minor as compared to that in tank 13, preferably being only about fifteen percent that of tank 13. The compressed body of air at A is now essentially an air spring resiliently acting against the water body W.

At this point the whole system is in equilibrium and there is no water flow. However the system is ready for operation according to the invention since pressure tank 26 is charged for action.

When the toilet bowl is to be flushed, the operator unseats ball valve 18 in the usual way and releases handle 21. This starts the usual downward flow of water under the pressure head of tank 13 through fitting 17. At about the same time as the reservoir water level recedes valve 14 is opened by the float and water at inlet mains pressure flows up pipe 15 through valve 14 to enter tank 13. This intake of water is only minor as compared to the sudden large volume discharge through the outlet at 17. An immediate low pressure region is established in the venturi fitting at the junction of pipe 15 and tube 24, creating essentially a suction effect in tube 24 which is transmitted to space 38.

Upon reduction of pressure in space 38 the air pressure in tank 26 acts to force the water level down in tube 42 until tube 42 is empty and check valve ball 45 seats at 40. This discharge of water from tube 42 until the check valve closes requires a certain time internal. The water from tube 42 and space 38 is discharged by reverse flow through tube 24.

After ball 45 seats, the suction applied through tube 24 is effective to immediately reduce the fluid pressure in space 38 to point where the pressure differential across piston 37 arising from the water pressure of space 39 aided by the atmospheric pressure available through conduit 27 acting on its lower side and the reduced pressure of space 38 acting on its upper side causes immediate upward displacement of piston 37 to unseat the valve element 43. Spring 40 when used is light enough to offer no effective resistance to this action. In some installations spring 40 might be eliminated, and actually a light biasing spring placed in space 30 to ensure prompt opening movement of the valve piston and eliminate valve sticking. Water from the pressure tank is now discharged at relatively high velocity through conduit 27 due to the pressure exerted by the now expanding air body A.

As it passes through nozzle assembly 28, the high velocity water from the pressure tank intersects and joins the water descending at the lower tank head pressure through the interior of nozzle assembly 28, and the added energy accompanied by the blade controlled direction of the high velocity water imparts swirl and turbulence to the greater mass of reservoir tank water reaching the bowl. The kinetic energy of the high velocity water from the nozzle adds to the pressure head energy of the column of water descending from the reservoir tank to increase the overall energy of the flushing water whereby an increased and improved flushing of the bowl is attained.

After the ball 18 descends and is again seated to close the reservoir tank discharge valve and while reservoir tank 13 is refilling, the control valve at 35 is held open by the differential pressure across the piston caused by pressure in space 39 and suction in space 38. This allows air in the pressure tank to return to atmospheric pressure before the pressure tank is recharged. Pressure tank 26 is automatically recharged as above explained and the system is again in equilibrium awaiting the next flush.

Location of the outlet of tube 42 above the water level in the pressure tank 26 serves as an anti-siphon arrangement so that in the event there is suction in the mains or there is a failure of the control valve, only air would be siphoned back through tube 24.

Thus in the invention means is effective during the period the pressure tank is being charged with water and air under pressure for storing a column of water in tube 42 which is distinct from the body of water in the lower part of pressure tank 26. Water in that column is exposed to pressure from the body of compressed air in pressure tank 26. Thus upon initiation of release of water from the primary body opening of the control valve is delayed by the time it takes to discharge the column of water from the tube 42 under air pressure from the upper part of the pressure tank 26. This time may be preset by varying the capacity of tube 42.

It will be seen from the foregoing that the action is similar to that in said Ser. No. 812,066, the difference being that in the present invention actuation of the control valve at 35 is controllably delayed by the amount of time it takes tube 42 to empty toward space 38. It is contemplated that this time delay may be accurately predetermined and set by selection of the size of passage 44 and/or the volumetric capacity of tube 42.

The proportions of the parts and the timing are such that the high velocity jet-like flow of water through the blades of nozzle assembly 28 takes place a controlled predetermined time after the primary body of water starts to leave reservoir tank 13 and discharges through the interior of the nozzle assembly whereby at least a considerably major amount of the descending reservoir water is subjected to the increased turbulence. By introducing the time delay the invention assures that the high velocity water will not impede start of gravity discharge of water from the reservoir tank and will be most effective in creating turbulence in the bowl especially in certain types of toilet assemblies.

Thus in the invention, each time the toilet is flushed the pressure tank 26 acts automatically to increase swirl and turbulence in the flush water and then will be automatically recharged, ready to be actuated in the succeeding flush operation. The operator needs do nothing more than in prior conventional systems.

While pressure tank 26 is disclosed as located within the reservoir tank 13, it is contemplated that in some installations it may be mounted externally of the reservoir tank and connected by suitable conduit arrangements to the venturi section of the inlet pipe and the interior of the bowl 11.

The venturi section may be located within the reservoir tank as shown or outside, as before pipe 15 enters the tank. The discharge of the outlet of the pressure tank 26 may in some installations introduce water directly into the bowl to join water from the reservoir tank in the bowl rather than at the nozzle assembly.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a flush toilet system having a bowl, a reservoir tank wherein water may be stored in a primary body at a predetermined level to establish a predetermined pressure head and means for selectively releasing water from said tank into the bowl during flushing, the provision of further means operative when water is released from said reservoir tank for automatically discharging a predetermined quantity of water from a source wherein water is contained at a pressure higher than the pressure of the water in the reservoir tank into water being released from said tank into said bowl at sufficiently high velocity to materially increase the overall energy of the water and in the bowl and effect increased efficiency during flushing, and means providing a predetermined time delay between initiation of release of water from said reservoir tank and discharge from said source.

2. In the flush toilet system defined in claim 1, said source being located within said reservoir tank.

3. In the flush toilet system defined in claim 1, said further means comprising a pressure tank and means whereby said predetermined quantity of water is stored in said pressure tank under a pressure appreciably higher than the pressure of the water in said reservoir tank and control valve means whereby water is automatically discharged from the pressure tank during release of water from said reservoir tank, and said means providing said time delay is means at said pressure tank effective to delay opening of said control valve means for a predetermined period after initiation of release of water from said primary body.

4. In the flush toilet system defined in claim 3, a supply line containing water at mains pressure connected by intake valve means to said reservoir tank and means providing a passage between said pressure tank and said supply line upstream of said intake valve means whereby water at mains pressure may be introduced into said pressure tank when said intake valve means is closed to be stored within until the pressure tank contains a body of water under pressure below a compressed air body, and said time delay means comprises means effective during the period said pressure tank is being charged with water and air under pressure for storing a column of water in a receptacle in said pressure tank distinct from said body of water but exposed to pressure from said compressed air body, and means whereby upon initiation of release of water from said primary body opening of said control valve is delayed by the time it takes to discharge said column of water from the receptacle under air pressure.

5. In the flush toilet system defined in claim 4, said receptacle being a tube mounted on a check valve seat in said passage and a floatable check valve element is disposed in said tube adapted to close said passage except when there is water in said tube.

6. In a flush toilet system having a bowl, a reservoir tank wherein water may be stored in a primary body at a predetermined level to establish a predetermined pressure head and means for selectively releasing water from said tank into the bowl during flushing, the provision of a water intake pipe extending to a water level controlled intake valve having an outlet to said tank, means providing a reduced fluid pressure region in said pipe, and means operative in predetermined timed relation to release of water from said reservoir tank for automatically discharging a predetermined quantity of water into water being released from said tank into said bowl at sufficiently high velocity to materially increase the overall energy of the water in the bowl and effect increased efficiency during flushing comprising a sealed pressure tank, a passage connecting said reduced pressure region to said pressure tank, an outlet conduit connected at one end to said pressure tank and connected at its other end to discharge water from said pressure tank toward said bowl to join water released from said primary body of water, a control valve in said pressure tank responsive to fluid pressure transmitted through said passage to open or close the outlet conduit at said one end, and means associated with said pressure tank for delaying opening of said outlet conduit a predetermined period after initiation of release of water from said reservoir tank.

7. In the flush toilet system defined in claim 6 said control valve comprising a cylinder having a valve seat in its lower portion located at said one end of the outlet conduit, a piston slidable in said cylinder and carrying a valve element adapted for coacting with said seat, said passage extending into the cylinder space and check-valved means providing an opening in the cylinder whereby water under pressure entering the cylinder while said control valve is closed is directed into the pressure tank to be stored therein until air and water pressures are equalized in said pressure tank, air being compressed in the space above the water in said pressure tank, aperture means connecting the cylinder space below said piston to the interior of said pressure tank, means effective when water from the reservoir tank is released to discharge toward said bowl and said water level controlled intake valve opens for creating reduced fluid pressure in said passage and in the space at the upper end of said piston whereby said piston is displaced upwardly to open said control valve and allow water under pressure from the pressure tank to be expelled through said aperture means to said outlet conduit, and said means for delaying opening of the outlet conduit comprising means for delaying the establishment of said reduced pressure at the upper end of said piston for said predetermined period.

8. In the flush toilet system defined in claim 7 said check-valved means comprising a tube of predetermined size mounted over said opening whereby water under pressure from the cylinder space above said piston fills said tube before entering said pressure tank when the control valve is closed, there being a check valve seat at said opening, said tube being open at its upper end to the compressed air space in said pressure tank and containing a floatable check valve element capable of permitting water flow past it except when seated at said opening which thereby closes said check valve opening only when there is no water in the tube and floats on the column of water in the tube while the pressure tank is being charged and after the fluid pressures are equalized in said pressure tank, whereby when reduced fluid pressure is applied to said passage the water in said tube and the upper cylinder space is caused to flow reversely through the passage at least until said valve element seats at said opening.

* * * * *